US005154407A

United States Patent [19]

Shidara

[11] Patent Number: 5,154,407

[45] Date of Patent: Oct. 13, 1992

[54] CUT SHEET FEEDER WITH SUCTION DEVICE

[75] Inventor: Shinichi Shidara, Tokyo, Japan

[73] Assignee: Fuji Photo Film Co., Ltd., Kanagawa, Japan

[21] Appl. No.: 865,661

[22] Filed: Apr. 7, 1992

Related U.S. Application Data

[63] Continuation of Ser. No. 593,720, Oct. 4, 1990, abandoned.

[30] Foreign Application Priority Data

Oct. 4, 1989 [JP] Japan ..... 1-257933

[51] Int. Cl.[5] ..... B65H 5/08

[52] U.S. Cl. ..... 271/12; 271/94; 271/96; 271/104; 271/108

[58] Field of Search ..... 271/5, 6, 12, 13, 34, 271/104, 107, 108, 94, 96, 258, 265

[56] References Cited

U.S. PATENT DOCUMENTS

| | | | |
|---|---|---|---|
| 2,970,834 | 2/1961 | Martin et al. | 271/34 X |
| 3,126,199 | 3/1964 | Rosoff | 271/12 |
| 3,198,514 | 8/1965 | Barbera et al. | 271/12 |
| 3,235,249 | 2/1966 | Street et al. | 271/12 |
| 3,511,368 | 5/1970 | Kajitani et al. | 271/34 |
| 3,625,508 | 12/1971 | Shiragai | 271/34 |

FOREIGN PATENT DOCUMENTS

| | | | |
|---|---|---|---|
| 18057 | 10/1980 | European Pat. Off. | 271/34 |

OTHER PUBLICATIONS

Anderson (Document Feeder and Separator), 1963, IBM Tech. Disclosure Bulletin, vol. 6, No. 2, p. 32.

*Primary Examiner*—Robert P. Olszewski
*Assistant Examiner*—Boris Milef
*Attorney, Agent, or Firm*—Sughrue, Mion, Zinn, Macpeak & Seas

[57] ABSTRACT

An improved cut sheet feeder for feeding cut sheets separately one by one, comprising a sheet feeding and conveying device for contacting the obverse side of a first sheet to move the first sheet forwardly by frictional force, an arresting device for contacting the reverse side of a next sheet to arrest forward movement of the next sheet, the frictional force applied by the sheet feeding and conveying device being larger than the frictional force applied by the arresting device. The improved cut sheet feeder comprises a suction device operatively associated with the sheet feeding and conveying device for sucking the first sheet to increase the frictional force between the first sheet and the sheet feeding and conveying device. In a modified embodiment, a suction device may be operatively associated with the arresting device rather than being operatively associated with the sheet feeding and conveying device. In a further modified embodiment, a suction device may be operatively associated with the arresting device in addition to the suction device operatively associated with the sheet feeding and conveying device.

14 Claims, 9 Drawing Sheets

CUT SHEET FEEDER WITH SUCTION DEVICE

This is a continuation of application No. 07/593,720 filed Oct. 4, 1990, now abandoned.

BACKGROUND OF THE INVENTION

1. Field of the Invention

The present invention relates to an improvement in the cut sheet feeder for feeding cut sheets separately one by one comprising sheet feeding and conveying means for contacting with the obverse side of a first sheet to move the first sheet forwardly by frictional force, and arresting means for contacting with the reverse side of a next sheet to arrest forward movement of the next sheet, the frictional force applied by the sheet feeding and conveying means being larger than the frictional force applied by the arresting means.

2. Prior Art

In various office automation systems, cut sheets each having predetermined dimensions are stacked to be fed separately one by one securely at high speed. The known cut sheet feeders include the friction type device in which cut sheets are fed by utilizing frictional force, and the suction type device in which cut sheets are fed by utilizing suction force developed by pneumatic negative pressure.

In the friction type device, an obverse side of a first cut sheet to be fed into the system is pressed by conveying means, such as a roller or a conveyor belt, so that the sheet is pulled by the frictional force generated between the sheet and the conveying means. However, in this type cut sheet feeder, due to the friction between the reverse side of the first sheet and the obverse side of the next sheet, there arises a tendency that the next sheet is moved together with the first sheet to induce a problem of overlapped feeding.

In order to prevent such an overlapped feeding, it has been proposed to provide a friction pad for contacting with the reverse side of the sheet to arrest forward movement of the next sheet, or to provide a friction roller contacting with the reverse side of the sheet and rotating in the direction for moving the next sheet backwards. However, in the device in which frictional force is utilized for the separation of adjacent sheets, since the difference in frictional force between the friction at the interface of the friction pad or roller and the reverse side of the sheet and the friction at the interface of adjacent sheets is utilized, the operation of separating the sheets becomes unstable as the quality or thickness of the sheet material is changed or the coefficient of friction is changed during the operation.

On the other hand, since the sheet is sucked and conveyed in the device in which suction force is utilized, a large size pneumatic pump must be assembled for developing high negative or sucking pressure. In addition, the sucking pressure must be controlled depending on the quality and thickness of the sheet material to be sucked, and the position of the sucking port must be shifted when the size of the sheet is changed.

OBJECTS AND SUMMARY OF THE INVENTION

An object of this invention is to provide an improved cut sheet feeder which is operated more stably and reliably as compared to the conventional friction type device to separate adjacent sheets positively even if the quality and/or thickness of the sheet material are changed.

Another object of this invention is to provide an improved cut sheet feeder in which assembled is a suction means which is smaller in size than that assembled in the conventional suction type device and which is controlled more easily.

The aforementioned objects of this invention are achieved by the provision of an improvement in the cut sheet feeder for feeding cut sheets separately one by one, comprising sheet feeding and conveying means for contacting with the obverse side of a first sheet to move the first sheet forwardly by frictional force, arresting means for contacting with the reverse side of a next sheet to arrest forward movement of the next sheet, the frictional force applied by said sheet feeding and conveying means being larger than the frictional force applied by said arresting means, the improvement comprising suction means operatively associated with said sheet feeding and conveying means for sucking said first sheet to increase the frictional force between said first sheet and said sheet feeding and conveying means.

The difference between the force (feeding force) for feeding the first sheet in the forward direction and frictional force at the interface of the first sheet and the next sheet is increased and the difference between the force (arresting force) for arresting the forward movement of the next sheet and the frictional force at the interface of the first sheet and the next sheet is also increased to ensure stable and reliable separation of the first sheet from the next sheet. The negative pressure developed by the suction means is lower than the negative pressure necessary for the conventional device in which only the suction force is utilized for the separation of adjacent sheets. Accordingly, a small size pneumatic system, for example an air blast fan or ventilation fan, may be used as the suction means in this invention.

The object of this invention may be achieved by the provision of additional suction means which is associated with the arresting means. In such a construction where a negative sucking pressure is developed in the arresting means, the difference between the feeding force and the frictional force at the interface of the first sheet and next sheet and the difference between the arresting force and the frictional force at the interface of the first sheet and next sheet are further increased to ensure more reliable separation of the first sheet from the next sheet.

According to a further aspect of this invention, the suction means may be associated with the arresting means rather than associating with the sheet feeding and conveying means. Separation of the next sheet from the first sheet is ensured by the provision of such suction means associated with the arresting means due to the increase in frictional force between the arresting means and the next sheet. This modification is particularly effective when a friction pad or roller having a high coefficient of friction is used as the material for the sheet feeding and conveying means.

PRINCIPLE OF THE INVENTION

Figure 11A:
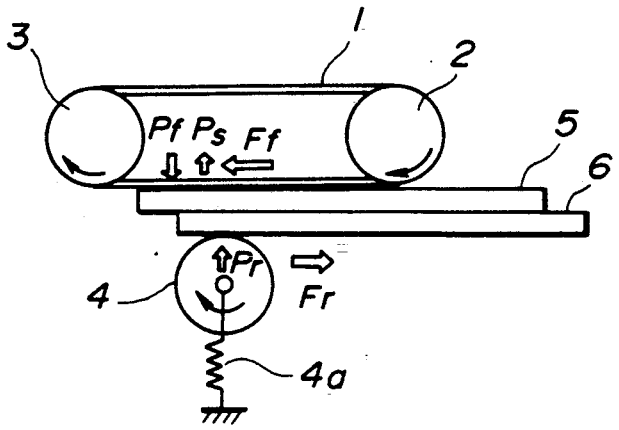
FIGS. 11A to 11E are graphical representations given for the illustration of the principle of this invention.
Figure 11B:
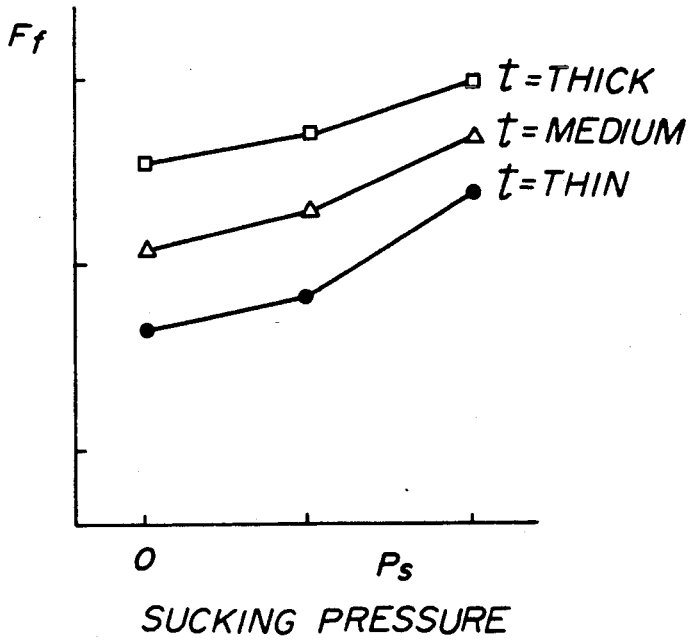
Figure 11C:
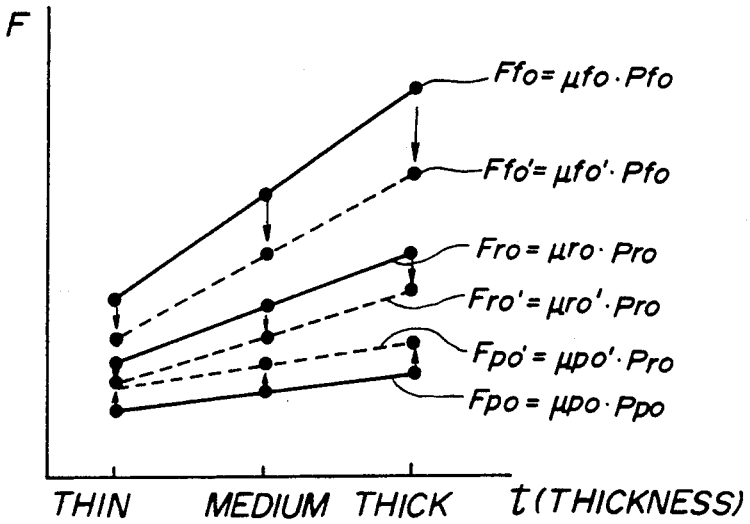
Figure 11D:
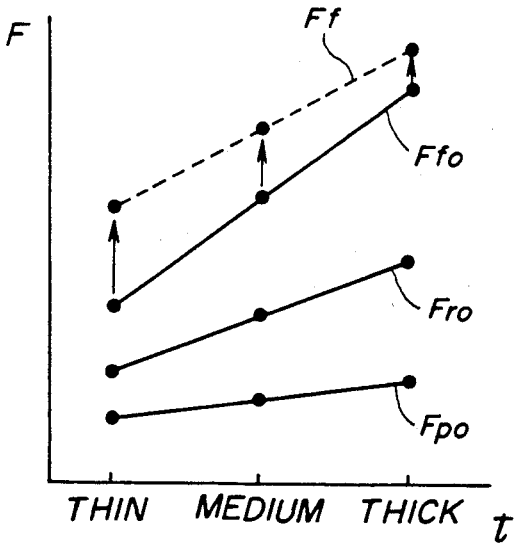
Figure 11E:
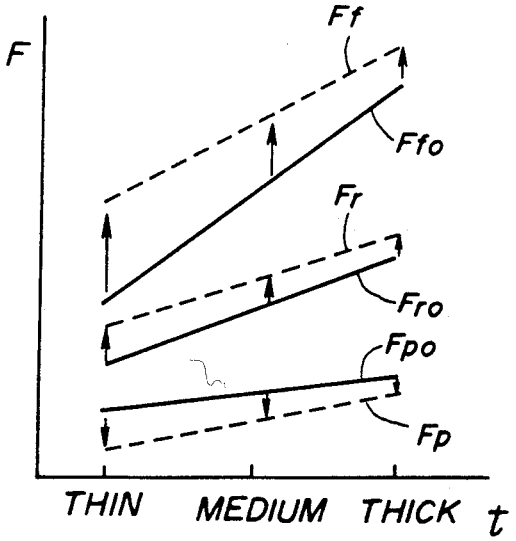

Initially, the principle of this invention will be described with reference to FIGS. 11A to 11E. FIG. 11A is a schematic view showing important parts of the cut sheet feeder of this invention; FIG. 11B is a graph showing the change in feeding force $F_f$ in terms of the sucking pressure $P_s$ applied on the sheet feeding and conveying means; FIG. 11C is a graph showing the changes in feeding force $F_{fo}$, reversing force $F_{ro}$ and frictional force $F_{po}$ between the adjacent sheets in terms of the thickness of the sheet in a conventional sheet feeder; FIG. 11D is a graph showing the changes in feeding force $F_{fo}$, reversing force $F_{ro}$ and frictional force $F_{po}$ in terms of the thickness of the sheet in a first embodiment of this invention in which the suction means is associated with the sheet feeding and conveying means; and FIG. 11E is a graph showing the changes in feeding force $F_{fo}$, reversing force $F_{ro}$ and frictional force $F_{po}$ between the adjacent sheets in terms of the thickness of the sheet in a second embodiment of this invention in which suction means are associated with both of the sheet feeding and conveying means and the arresting means.

Referring to FIG. 11A, a feed belt is denoted by numeral 1 and runs around paired feed rollers 2 and 3. A reverse roller 4 rotates in the direction reverse to the running direction of the feed belt 1 and is biased by a coil spring 4a to contact with the feed belt 1. Cut sheets 5 each having predetermined size or dimensions are fed from the right to the left as viewed in FIG. 11A, and the lower sheet 6 is moved backwards by the reverse roller 4. The feeding force $F_{fo}$, i.e. the force applied on the upper sheet 5 by the feed belt 1 to move the sheet 5 in the left-hand direction is represented by the following equation of:

$$F_{fo}=\mu_{fo}\times P_{fo};$$

wherein $\mu_{fo}$ is the coefficient of friction between the feed belt 1 and the obverse side of the upper sheet 5, and $P_{fo}$ is a contact pressure. The reversing force $F_{ro}$, i.e. the force applied on the lower sheet 6 by the reverse roller 4 to move the sheet 6 in the backward direction (in the right-hand direction as viewed in FIG. 11A) is represented by the following equation of:

$$F_{ro}=\mu_{ro}\times P_{ro};$$

wherein $\mu_{ro}$ is the coefficient of friction between the reverse roller 4 and the reverse side of the lower sheet 6, and $P_{ro}$ is a contact pressure. The frictional force $F_{po}$ between the sheet 5 and the sheet 6 is represented by the following equation of:

$$F_{po}=\mu_{po}\times P_{po};$$

wherein $\mu_{po}$ is the coefficient of friction between the upper sheet 5 and the lower sheet 6, and $P_{po}$ is a contact pressure.

In the conventional friction type sheet feeder in which sucking pressure is not applied, the sucking pressure $P_{so}$ is zero, and thus $P_{fo}=P_{ro}=P_{po}=P$. In order to separate the sheet 5 securely from the sheet 6 under this condition, the forces $F_{fo}$, $F_{ro}$ and $F_{po}$ must satisfy the interrelation as shown by the real line in FIG. 11C. Accordingly, the following inequalities must be always satisfied.

$$F_{fo}>F_{ro}>F_{po};$$

$$\mu_{fo}>\mu_{ro}>\mu_{po}.$$

However, in practice, the coefficients of friction $\mu_{fo}$, $\mu_{ro}$ and $\mu_{po}$ are affected to be changed by the change in quality and/or thickness of the sheet, humidity, stains on the belt 1 or roller 4 and other factors affecting the conditions of frictional contact. When the inequality $F_{fo}>F_{ro}>F_{po}$ is not satisfied due to the change in coefficients of friction, the lower sheet 6 cannot be separated from the upper sheet 5. The broken lines $F_{fo}'$, $F_{ro}'$ and $F_{po}'$ show the cases where these forces become close to each other. It is seen from FIG. 11C that these forces become closer particularly when the thickness of the sheet is thin to unstabilize the sheet separating operation. Although the feeding force $F_{fo}'$ and the reversing force $F_{ro}'$ may be increased by increasing the contact pressure P, the contact pressure $P_{po}$ between the sheet 5 and the sheet 6 is also increased to make it difficult to ensure separation of the adjacent sheets.

According to this invention, a sucking pressure $p_s$ is applied on the upper sheet 5 to suck the sheet 5 onto the feed belt 1 to solve the problem. Referring now to FIG. 11D, by the application of the sucking force $P_s$, the feeding force $F_f$ applied on the upper sheet 5 is increased as represented by the following equation of:

$$F_f=\mu_f(P_f+P_s)$$

Since the sucking force $P_s$ is not applied on the lower sheet 6, the forces $F_{ro}$ and $F_{po}$ are not substantially changed. The increase of the feeding force $F_f$ becomes larger as the thickness of the sheet is thinner, as shown by the broken lines in FIGS. 11C and 11D. As a result, the difference between the force $F_f$ and the force $F_{ro}$ and the difference between the force $F_{ro}$ and the force $F_{po}$ become larger to attribute significant improvement in separation of thin sheets.

In addition to the application of sucking force from the feeding belt side, a sucking force may be applied also from the opposing side at which the arresting means is disposed. In such a case, the reversing force $F_{ro}$ is increased to $F_r$ as shown by the broken line in FIG. 11E, and simultaneously the frictional force between the upper sheet 5 and the lower sheet 6 is decreased from $F_{po}$ to $F_p$ since the contact pressure $p_p$ between these sheets 5, 6 is lowered. As a result, the difference between the feeding force $F_f$ and the frictional force $F_p$ is further increased and the difference between the reversing force $F_r$ and the frictional force $F_p$ is also increased to ensure more stable separation of the sheet 6 from the sheet 5.

When the feeding force is set to a sufficiently high intensity by using plural feed belts or by fabricating the feed belt from a material having a higher coefficient of friction, the object of this invention may be achieved only by applying a sucking force from the side at which the arresting means is disposed.

DESCRIPTION OF PREFERRED EMBODIMENTS

Preferred embodiments of this invention will now be described with reference to FIGS. 1 to 10.

Figure 1:
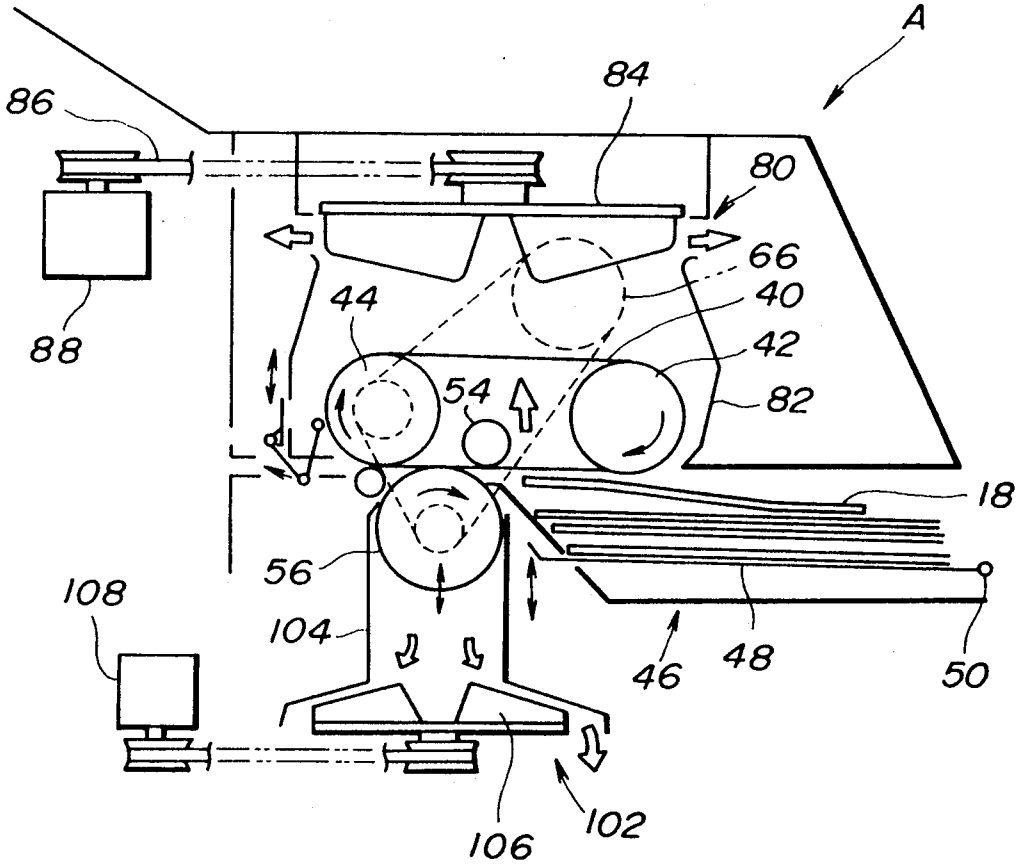
FIG. 1 is a side elevational view schematically showing one embodiment of this invention.
Figure 2:
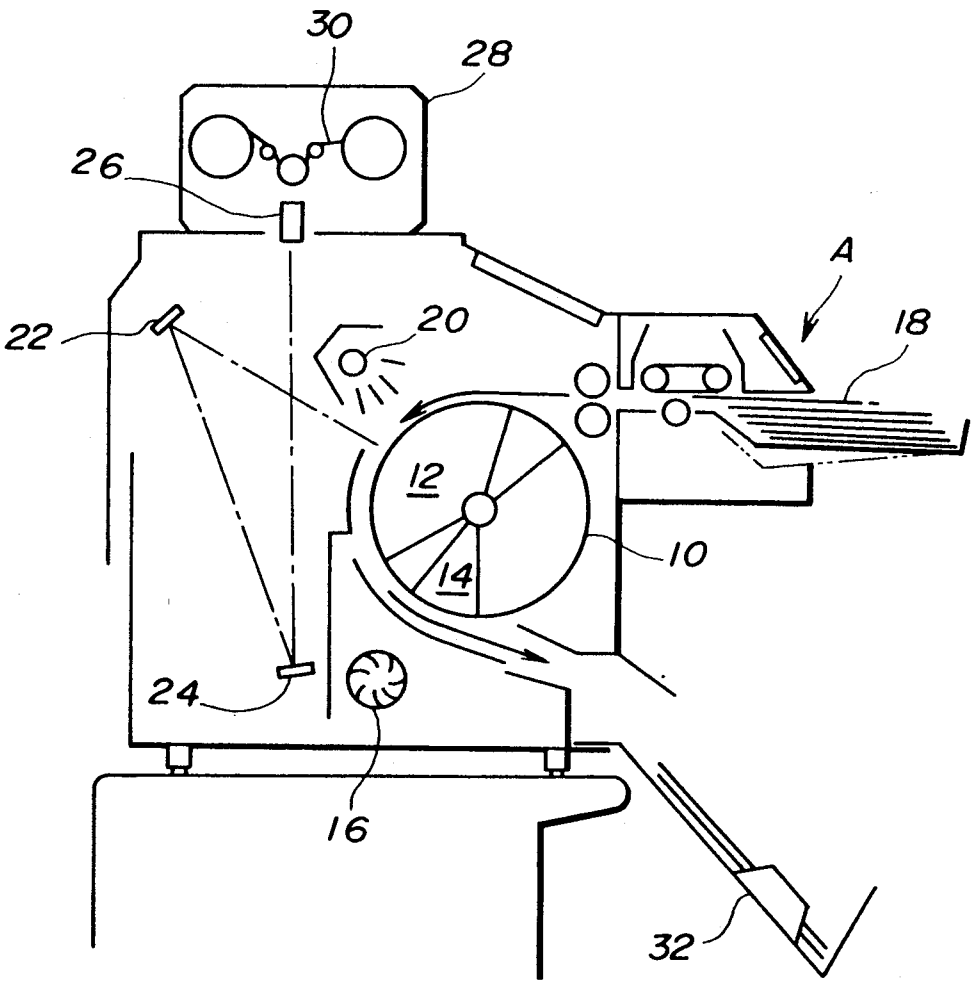
FIG. 2 is a side elevational view schematically showing a rotary microfilm camera in which the embodiment shown in FIG. 1 is assembled.

FIG. 1 shows schematically a first embodiment of this invention, which is assembled in a rotary microfilm camera shown in FIG. 2.

In the illustrated rotary camera, an original document or picture borne on each of the sheets fed by a cut sheet feeder A according to this invention is photographed on a frame of microfilm roll. The rotary camera has a construction principally the same as disclosed in Japanese Patent Application No. 184480/1988 (laid open to the public by Unexamined Japanese Patent Publication No. 35434/1990; corresponding to U.S. Pat. No. 4,975,733), and thus will be described briefly.

Referring to FIG. 2, reference numeral 10 designates a rotary drum having a surface provided with a number of small through-holes, the interior of the rotary drum 10 is divided by partition walls into a negative pressure chamber 12 and a positive pressure chamber 14. The negative pressure chamber 12 is communicated with a not-shown suction fan to be held at a reduced pressure, and the positive pressure chamber 14 is communicated with a not-shown air blast fan to be held at a positive pressure. When a sheet 18 is fed on the surface of the drum 10 subtending the negative pressure chamber 12, the sheet 18 is sucked onto the surface of the drum 10 by the action of the negative pressure in the negative pressure chamber 12 to be rotated in the counter-clockwise direction as viewed in FIG. 2. The original image on the sheet 18 is irradiated by a light from a light source 20 so that the image of the original on the sheet 18 is transmitted through reflectors 22, 24 and a lens 26 to a film magazine 28. In the film magazine 28, the image is photographed on a frame of a microfilm roll 30 which is fed in synchronism with the movement of the drum 10. After photographing the original on the sheet 18, the sheet 18 is separated from the surface of the drum 10 by the action of air blown from the positive pressure chamber 14 to be received in a discharge tray 32. Air is blown toward the discharge tray 32 by a fan 16 to facilitate smooth discharge of the photographed sheet 18.

The cut sheet feeder A according to a first embodiment of this invention will now be described with reference to FIG. 1 and FIGS. 3 to 8.

In these Figures, reference numeral 40 designates a feed belt assembly which runs around feed rollers 42, 44. The feed belt assembly 40 may comprise plural belts running parallel with each other and spaced by proper spacings. In the illustrated embodiment, three feed belts 40 are provided. A stack of cut sheets 18 is contained in a cassette 46 having a bottom plate 48 which is resiliently biased upwards to swing about a pivot point 50 so that the surface of the uppermost sheet 18 is pressed to the feed belts 40 running around the feed rollers 42, 44. As the feed belts 40 are moved, the sheet 18 is conveyed in the forward direction. The feed belts 40 serve as the sheet feeding and conveying means for feeding and conveying the sheets 18.

The cassette 46 has a forward wall 52 slanting to the sheet feeding direction to facilitate separation of adjacent sheets 18. Intermediate rollers 54 protrude through the spacings between the feed belts 40 (see FIG. 5) to face the upper edge of the forward wall 52 (see FIG. 3). The intermediate rollers 54 are fixed to a duct 82, which will be described in detail hereinafter, so that the vertical movement thereof is limited to leave a constant gap between the upper edge of the forward wall 52 and the intermediate rollers 54, so that the intermediate rollers 54 serve as complemental means for preventing plural sheets 18 from being fed in the overlapped condition.

When plural sheets 18 are fed in-between the gap between the sheet feeding and conveying means 40 and the arresting means 56 (as will be described hereinafter), the sheets are firmly clamped by the sheet feeding and conveying means 40 and the arresting means 56 to lower the effect of the suction means 80 associated with the sheet feeding and conveying means 40. This is because the frictional force $F_p$ and the reversing force $F_R$ are abruptly increased due to the increase of the contact forces between the sheets 18.

According to the present invention, the gap between the intermediate rollers 54 and the outlet port of the cassette 46 is retained to have an extent to prevent feeding of overlapping plural sheets 18. Accordingly, only one sheet or overlapping sheets having a total thickness less than the gap between the intermediate rollers 54 and the outlet port of the cassette 46 is allowed to pass therethrough, whereby the separation effect exerted by the suction means 80 associated with the sheet feeding and conveying means 40 is fully achieved to ensure stable and reliable feeding and separation of individual sheets 18.

Figure 3:
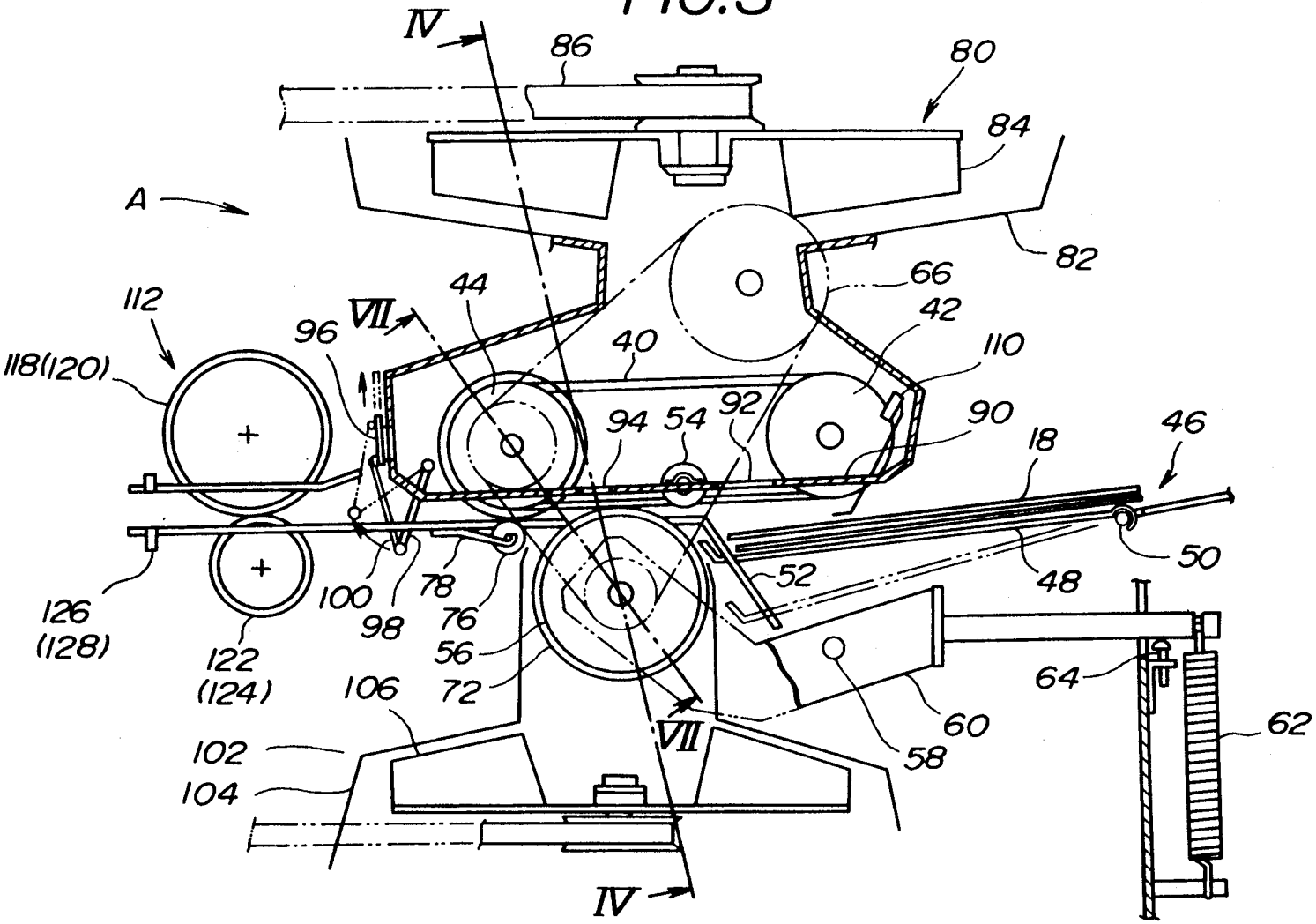
FIG. 3 is a side elevational view showing the detailed construction of the embodiment shown in FIG. 1.

A reverse roller 56 is provided to contact with the reverse side of the next sheet adjacent to the sheet 18 to be fed by the feed belts 40 to serve as the means for arresting forward movement of the next sheet. As shown in FIG. 3, the reverse roller 56 is mounted on one end of paired swingable arms 60, which are swung about pivot points 58, the other ends (right-hand ends as viewed in FIG. 3) of the swingable arms 60 are pulled downwards by coil springs 62 and the counter-clockwise rotation thereof are prevented by the stoppers 64.

Figure 4:
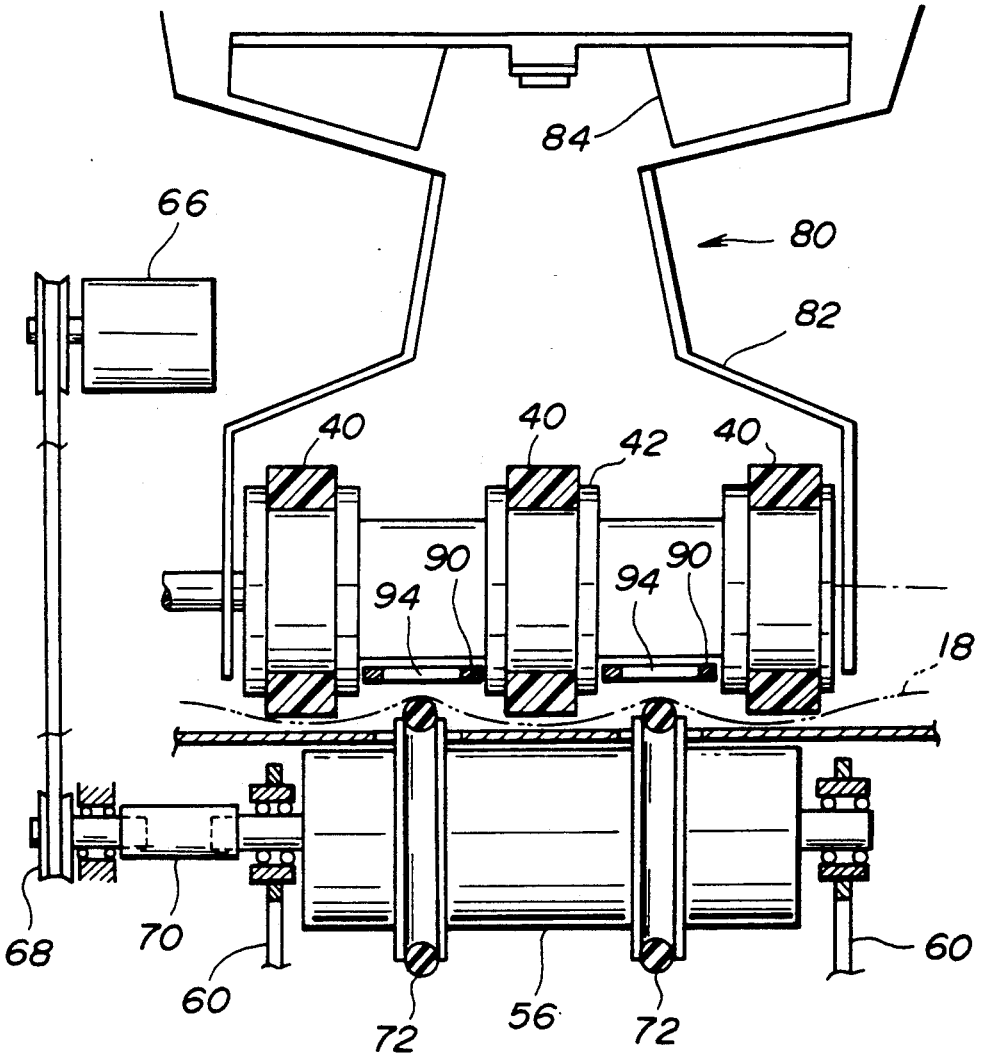
FIG. 4 is a sectional view taken along line IV—IV of FIG. 3.
Figure 5:
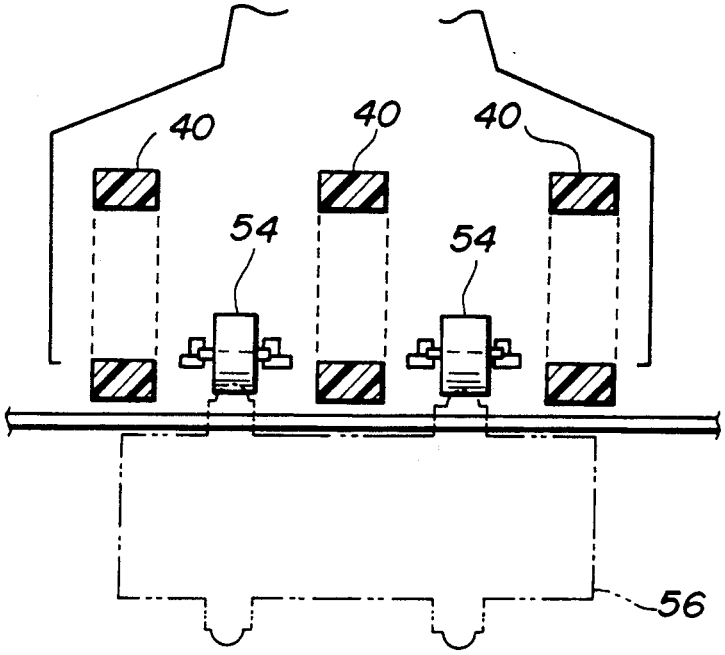
FIG. 5 is a sectional view showing intermediate rollers and related parts.

The feed rollers 44 and the reverse roller 56 are rotated through belts in the clockwise direction as viewed in FIG. 3 by means of a motor 66, and the reverse roller 56 rotates at a speed about two times as high as the rotational speed of the feed rollers 44 to facilitate rapid separation of the uppermost sheet from the next sheet. Since the reverse roller 56 is moved in the vertical direction as the thickness of the sheet stack is decreased, the shaft of the reverse roller 56 is connected through a spring joint 70 to a pulley block 68 which is driven through a belt by the motor 66 (see FIG. 4). Two annular lands or rings 72 are provided on the reverse roller 56 at the positions facing the spacings between the three feed belts 40. The top faces of these annular rings 72 are positioned at a level higher than the lower surfaces of the feed belts 40 when the swingable arms 60 abut against the stoppers 64 (see FIG. 4), so that the sheet 18 conveyed by the feed belts 40 are bent by the lower surfaces of the belts 40 and the top faces of the rings 72 to be retained in the waved form. When the sheet 18 is thick or hard, the reverse roller 56 is lowered to permit smooth passage of the thick or hard sheet 18. Since the reverse roller 56 is not positioned just beneath the forward feed rollers 44, but is disposed below the rollers 44 at a dislocated position as shown in FIG. 3, the reverse roller 56 can be moved to a position so that the top surfaces of the rings 72 are held at the level higher than the lower surfaces of the feed belts 44, as shown in FIG. 4, to further improve the effect of preventing overlapped feeding of sheets 18. This is particularly advantageous when thin sheets are handled by the cut sheet feeder A.

It is desirous to select the number and material of the feed belts 40 so that the feeding force $F_f$ applied by the feed belts 40 is larger than the force (reversing force $F_r$) applied by the ring 72 for arresting forward movement of the next sheet. For example, silicone rubber belts are used for the feed belts 40, and neoprene rubber belts are used for the rings 72.

Figure 7:
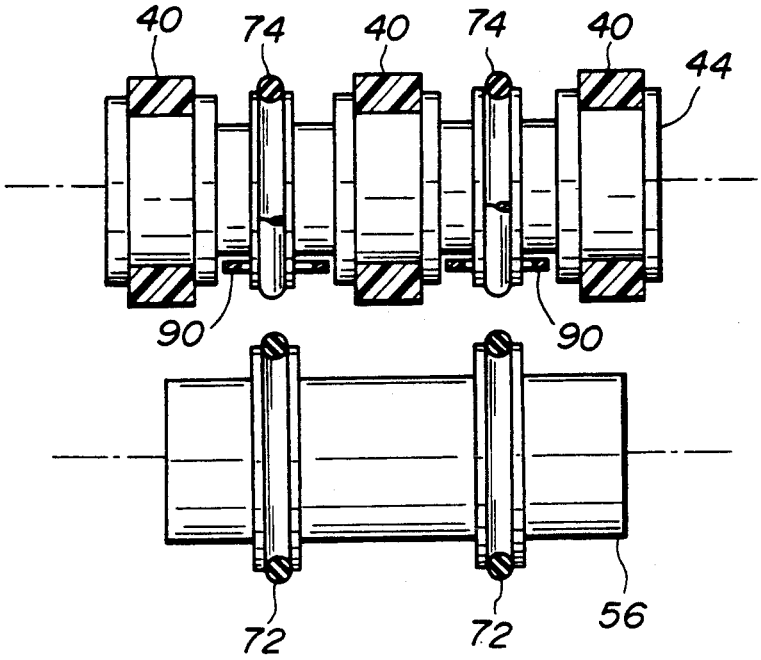
FIG. 7 is a sectional view taken along line VII—VII of FIG. 3.

When the sheet 18 is very thin and easily bent, two or more sheets 18 might be passed between the feed belts 40 and the rings 72 in the overlapping condition. In order to prevent such a malfunction, rings 74 are provided between the feed belts 40, as shown in FIG. 7, to prevent excessive bending of the sheet 18.

Figure 6:
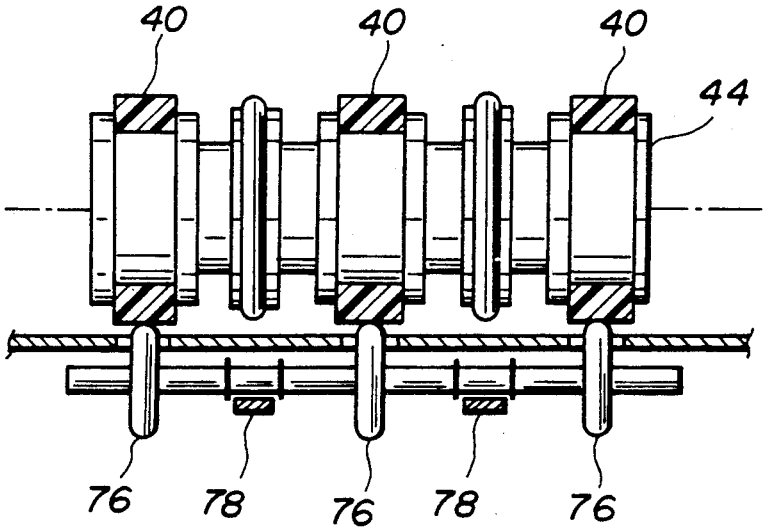
FIG. 6 is a sectional view showing dispensing rollers and related parts.

Dispensing rollers 76 are rotatably pressed onto the forward or outlet feed rollers 44 by leaf springs 78 (see FIG. 6). The dispensing rollers 76 are provided to press the sheet 18 moved between the feed rollers 44 and the dispensing rollers 76 onto the feed belts 40 to compensate the feeding force applied on the aft end of the sheet 18 so as to transmit the feeding force securely until the sheet 18 has been passed entirely through the feed rollers 44 and the dispensing rollers 76. By the provision of the dispensing rollers 76, the sheets 18 are conveyed more stably.

The suction means 80 associated with the sheet feeding and conveying means will now be described. A metal plate duct 82 has a lower portion covering the feed belts 40 and the feed rollers 42, 44, and an upper portion serving as a case for a centrifugal fan 84. The centrifugal fan 84 is rotated, for example, through a belt 86 by a motor 88 (see FIG. 1) to develop a negative pressure of about 5 to 10 cmHg within the duct 82. The bottom of the duct 82 is formed by an air-shield plate 90 which covers the openings extending along the fore and aft direction of the feed belts 40 to leave openings 92, 94, as shown in FIGS. 3 and 4, at the positions where large sucking pressure should be applied. The opening 92 faces to a sucking port at which the leading end of the uppermost sheet 18 contained in the cassette 46 is sucked, and the opening 94 faces a separating position at which the plural overlapping sheets 18 are separated under the actions of the feed belts 40 and the reverse roller 56. By applying the sucking pressure concentratedly from the openings 92, 94 at the sucking port and the separating position, the capacity of the centrifugal fan 84 can be decreased.

In the illustrated embodiment, the opening 94 serving as the suction means associated with the sheet feeding and conveying means faces to the forward end of the cassette 46. In detail, the leading end of the first or uppermost sheet 18 contained in the sheet cassette 46 faces to the undersides of the feed belts 40, the surface of the uppermost sheet 18 being held at a level lower than the top edge of the reverse roller 56, and the uppermost sheet 18 is sucked from the sheet cassette 46 by the suction means 80 to increase the sucking pressure for sucking the sheet 18 onto the feed belts 40. As a result, the feeding force applied by the feed belts 40 is increased, and the difference between the feeding force and the frictional force at the interface of the adjacent sheets is increased, whereby the separation of the uppermost sheet from the next sheet is promoted. As a result, feeding of overlapping sheet stack having a thickness more than a pre-set thickness into the gap between the sheet feeding and conveying means and the arresting means is prevented to allow full exertion of the separation effect by the suction means associated with the sheet feeding and conveying means.

The duct 82 is provided with an air valve 96. The air valve 96 has a lever 98 positioned forward of the feed rollers 44 and to be pushed upwards by the sheet 18, and a link 100 connecting the swinging end of the lever 98 to the valve 96. As the sheet 18 is separately conveyed through the feed rollers 40 and the reverse roller 56, the fore end of the sheet 18 pushes the lever 98 to the position shown by the dots-and-dash line in FIG. 3, whereupon the lever 98 is swung to push the air valve 96 upwards through the link 100. As the air valve 96 is opened, air is introduced into the duct 82 to lower the negative pressure within the duct 82 (so that the pressure in the duct 82 becomes close to the atmospheric pressure). Under this condition, the next sheet 18 is not sucked to the opening 92 to prevent from being conveyed by the feed belts 40. The next sheet 18 is not fed until the first sheet 18 is passed through the lever 98 entirely to close the air valve 96, whereby the sheets 18 are fed at a constant spacing with each other.

Reference numeral 102 designates additional suction means associated with the arresting means. The suction means 102 comprises a duct 104 and a centrifugal fan 106. The duct 104 is disposed below the reverse roller 56 to cover the reverse roller 56 so that the space at the vicinity of the upper edge of the reverse roller 56 is maintained at a negative pressure developed by the fan 106. The fan 106 is driven, for example, through a belt by a motor 108 (see FIG. 1).

The operation of the system provided with additional suction means will now be described. As the cassette 46 containing the stacked sheets 18 is set in position, the bottom plate 48 pushes the stacked sheets 18 upwardly. As the stacked sheets 18 are set in position, a sheet sensor 110 (see FIG. 3) comprising a limit switch is actuated so that the cut sheet feeder A is ready for operation. When a start button (not shown) is pressed by a user, the motors 66, 88 and 108 are begun to rotate. The feed belts 40 are rotated, and the fan 84 of the suction means 80 associated with the sheet feeding and conveying means is also rotated to develop a negative pressure within the duct 82. The sheet 18 is fed in the feeding direction (in the upward and left-hand direction as viewed in FIG. 3) by a sufficiently high feeding force $F_f$ under the action of the frictional force applied by the feed belts 40 in combination with the sucking force applied from the opening 92 on the sheet 18. The gap between the intermediate rollers 54 and the forward wall 52 of the cassette 46 serves as complemental means for preventing overlapped feeding, and the feeding force $F_f$ is applied on the upper or obverse surface of the sheet 18 and the arresting force (reversing force) $F_r$ is applied on the under or reverse surface of the sheet 18. The feeding force $F_f$ and the reversing force $F_r$ are represented respectively by the following equations of:

$$F_f = \mu_f(P_f + P_{S1})$$

$$F_r = \mu_r(P_r + P_{S2})$$

wherein $P_f$ is a contact pressure between the feed belts 40 and the sheet 18, $P_r$ is a contact pressure between the reverse roller 56 and the sheet 18, $P_{S1}$ is the sucking pressure applied by the suction means associated with the feeding and conveying means, and $P_{S2}$ is the sucking pressure applied by the suction means associated with the arresting means.

As has been described in the Principle of the Invention, the difference between the feeding force $F_f$ and the frictional force $F_p$ at the interface of adjacent sheet is increased and the difference between the reversing force $F_r$ and the frictional force $F_p$ at the interface of adjacent sheet 18 is also increased to ensure reliable separation of the first sheet 18 from the next sheet 18. As the first sheet 18 pushes the lever 98, the air valve 96 is opened to lower the negative pressure within the duct 82 to stop feeding of the next sheet 18. When the first sheet 18 passes through the lever 98, the air valve 96 is closed to begin feeding of the next sheet 18.

Figure 8:
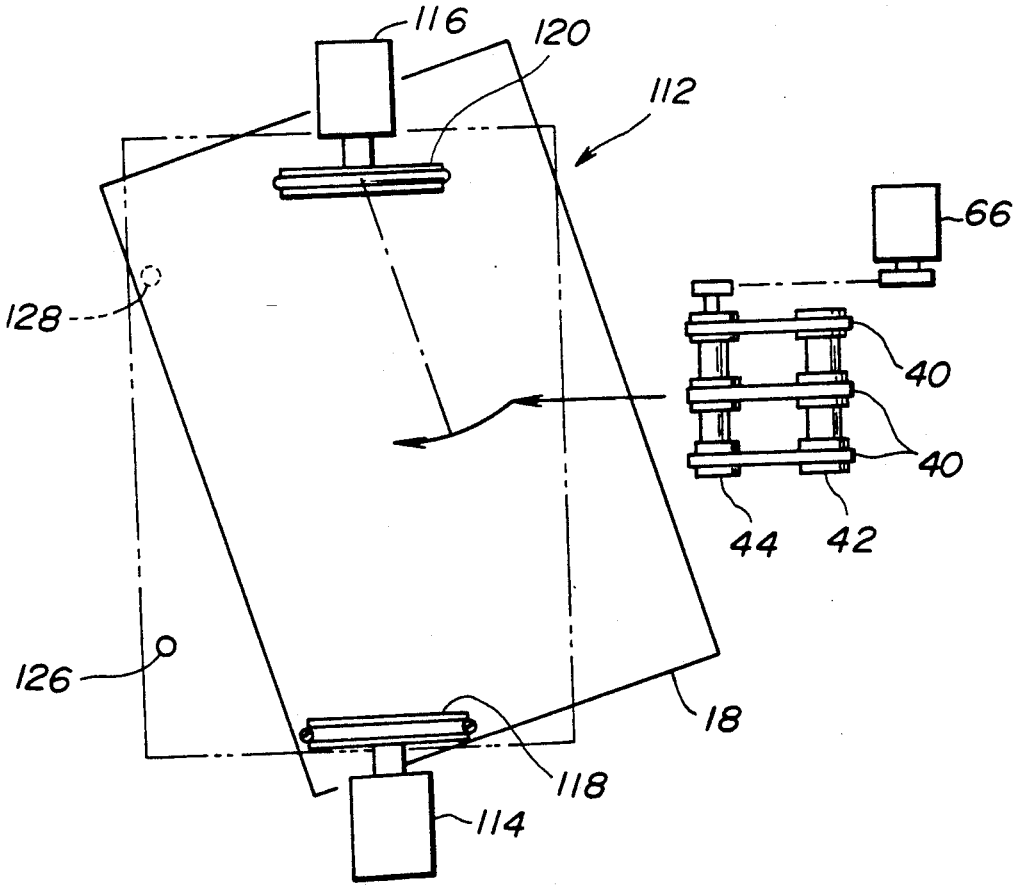
FIG. 8 is a plan view diagrammatically showing the mechanism for correcting the orientation of the sheet.

The illustrated embodiment is provided with a mechanism 112 for correcting the orientation of the sheet 18. The mechanism 112 comprises, as shown in FIGS. 3 and 8, paired rollers 118 and 120 driven by stepping motors 114 and 116, pinch rollers 122 and 124 rotatably contacting with the rollers 118 and 120, and paired photo-sensors 126 and 128 positioned downstream of these rollers to detect the leading end of the sheet 18. When the sheet 18 conveyed by the belts 40 is oblique to the normal orientation, the leading end of the obliquely oriented sheet 18 shields only one of the photo-sensors 128 (or 126), whereupon only the left (or right) roller 118 (or 120) is rotated until both of the photo-sensors 126 and 128 detect the leading end of the sheet 18. The orientation of the sheet 18 is thus corrected, and then the sheet 18 is moved to the position facing the rotary camera.

Figure 9:
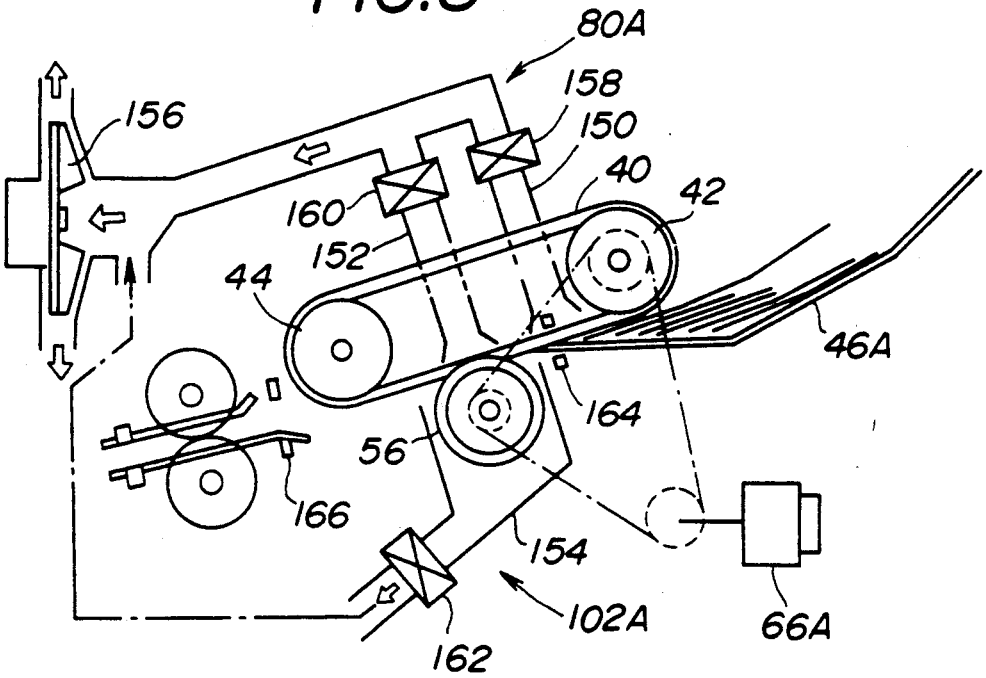
FIG. 9 is a side elevational view schematically showing a second embodiment of this invention.

A second embodiment of this invention is shown in FIG. 9. In the second embodiment, suction means 80A associated with the sheet feeding and conveying means comprises ducts 150, 152 for communicating required sucking ports with a suction fan 156, and suction means 102A associated with the reversing means comprises a duct 154 for communicating the reverse roller 56 with the suction fan 156. The ducts 150, 152 and 154 are provided with electromagnetic valves 158, 160 and 162 for opening and closing respective ducts. The timing for opening or closing each of the electromagnetic valves 158, 160 and 162 is determined by detecting the position of the conveyed sheet 18 by proper sensors 164 and 166. By properly controlling the opening or closing of these valves, respective sucking ports are opened depending on the position of the conveyed sheet 18, for example, simultaneously with or with a certain time delay after the sensing of the sheet 18, so that of the sheets 18 are fed and conveyed successively at a proper spacing.

Figure 10:
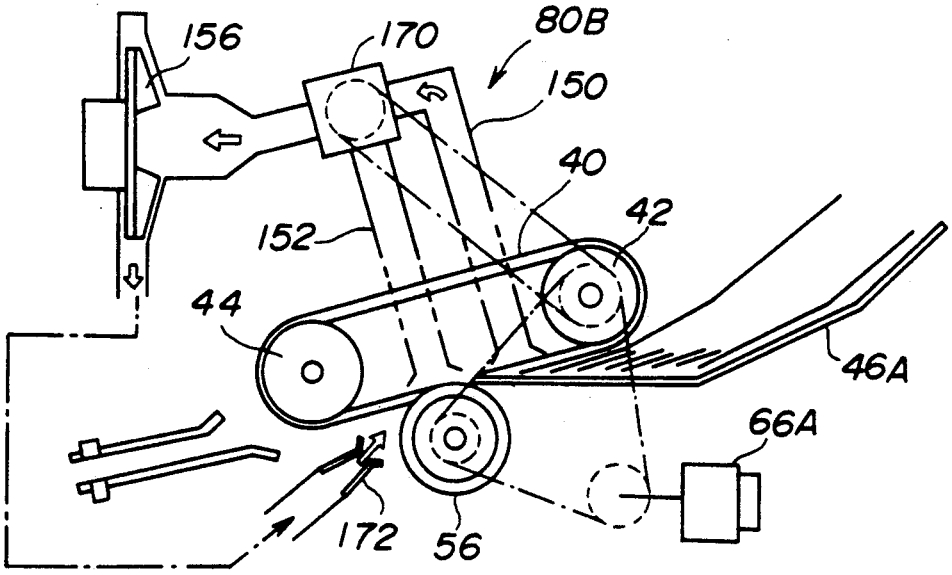
FIG. 10 is a side elevational view schematically showing a third embodiment of this invention.

A third embodiment of this invention is shown in FIG. 10. In this embodiment, suction means 80B associated with the sheet feeding and conveying means is controlled by a mechanical rotary valve 170 in lieu of the electromagnetic valves 158 and 160 used in the second embodiment shown in FIG. 9. The rotational movement of the feed rollers 42 is transmitted at a proper ratio to the valve 170 so that the valve 170 is rotated in synchronism with the moved length of the sheet 18 to communicate the ducts 150 and 152 with the negative pressure source 156 as the sheet 18 is moved to predetermined positions. Meanwhile, in this embodiment, no suction means is associated with the reverse roller 56, but air discharged from the fan 156 is ejected from a nozzle 172 along the leading end of the conveyed sheet 18 to facilitate separation of adjacent sheets 18.

In the embodiments shown in FIGS. 9 and 10, the feed roller 42 positioned close to a cassette 46A is driven by a motor 66A. With this construction, in case where a large driving force is applied on the belts 40 when the last sheet 18 contained in the cassette 46 is conveyed, the belts 40 slackens at the side of the reverse roller 56. As a result, the contact force between the belts 40 and the reverse roller 56 is decreased to prevent abrasion of the reverse roller 56.

Although the embodiments of this invention have been described to be assembled in a rotary camera to feed original sheets 18, the cut sheet feeder of this invention may be assembled in various instruments, such as a copying machine, a facsimile or a printer, or may also be assembled in apparatuses in which bank notes or cards are separately handled. Accordingly, the present invention should be deemed to include cut sheet feeders assembled in various instruments.

Although the reverse roller 56 is used as the arresting means for arresting forward movement of the next sheet in each of the illustrated embodiments, a frictional material which does not rotate, such as a friction pad, may be used as the arresting means within the scope of the invention.

The suction means may be associated with both of the sheet feeding and conveying means and the arresting means as in the illustrated embodiments, or the suction means may be associated with either one of the sheet feeding and conveying means or the arresting means.

As will be appreciated from the foregoing, according to one aspect of this invention, suction means is provided for sucking a first sheet onto the sheet feeding and conveying means to increase the frictional force between the obverse surface of the first sheet and the sheet feeding and conveying means, whereby the difference between the feeding force for moving the first sheet in the forward direction and the frictional force at the interface of the first sheet and the second sheet is increased, and the difference between the reversing force for arresting the forward movement of the next sheet and the frictional force at the interface of the first sheet and the second sheet is also increased, whereby the first sheet is separated from the second sheet stably and reliably. It suffices to develop a lower negative pressure, as compared to the negative pressure needed in the conventional suction type sheet feeder, for using as the sucking pressure in the sheet feeder of this invention. Accordingly, a large size suction pump used in the conventional suction type sheet feeder can be replaced by a small size suction pump. For instance, an air blast fan may be used as the suction means in the present invention to make it possible to control the entire system in a simple manner.

When suction means is associated with the arresting means (sheet reversing side) in addition to the suction means associated with the sheet feeding and conveying means, the difference between the feeding force and the frictional force at the interface of the first sheet and the next sheet is increased with the increase in difference between the arresting force (reversing force) and the frictional force at the interface of the first sheet and the next sheet, whereby the first sheet is separated from the next sheet more reliably.

According to a further aspect of this invention, the suction means may be associated only with the arresting means to increase the frictional force applied on the reverse surface of the next sheet to promote separation of the first sheet from the next sheet. This construction is particularly advantageous when the sheet feeding and conveying means is made of a material having a high coefficient of friction to exert a high feeding force.

Since the sheet feeding and conveying means comprises feed belts each running around plural feed rollers and the arresting means comprises a reverse roller facing the feed belts, the fed sheet is conveyed under stable condition forwardly along the feeding direction and the conveyed sheet can be separated reliably from the next sheet by the application of a negative pressure applied on the sheet conveyed by the feed belts.

What is claimed is:

1. A cut sheet feeder for feeding cut sheets arranged in a stack separately one by one, comprising:

sheet feeding and conveying means for contacting the obverse side of a first sheet to move the first sheet forwardly by frictional force;

arresting means for contacting the reverse side of a second sheet to arrest forward movement of the second sheet, the frictional force applied by said sheet feeding and conveying means being larger than the frictional force applied by said arresting means; and suction means operatively associated with said sheet feeding and conveying means for attracting said first sheet to increase the frictional force between said first sheet and said sheet feeding and conveying means, wherein said sheet and conveying means comprises a plurality of spaced apart feed belts running around forward and rearward feed rollers, and intermediate rollers disposed between said forward feed roller and said rearward feed roller to face the forward or discharge end of said stack of cut sheets while leaving a gap between said intermediate rollers and said discharge end, and wherein said intermediate rollers protrude through the space between each of said feed belts.

2. The cut sheet feeder of claim 1, wherein said arresting means comprises a reverse roller facing said feed belts and rotating in the direction for moving said second sheet in backward direction.

3. The cut sheet feeder of claim 2, further comprising a dispenser roller rotatably biased against the forward feed roller so that said first sheet is firmly grasped between said dispenser roller and said forward feed roller during conveyance of said first sheet.

4. The cut sheet feeder of claim 1, wherein said suction means has plural sucking ports which are opened and closed in synchronism with the position of said first sheet during the conveying operation.

5. The cut sheet feeder of claim 4, wherein said suction means comprises a suction fan, duct means for communicating said suction fan with said plural sucking ports, and a valve which is opened to communicate said duct means with the atmosphere when the leading end of said first sheet passes through a pre-set position.

6. The cut sheet feeder of claim 5, wherein said valve is connected through a link to a lever positioned forward of said sheet feeding and conveying means to be pushed by the leading end of said first sheet to be swung to open said valve.

7. The cut sheet feeder of claim 4, wherein said suction means comprises a suction fan, duct means for communicating said suction fan with said plural sucking ports, and electromagnetic valves for opening and closing said duct means to communicate and discommunicate said suction fan with said plural sucking ports.

8. The cut sheet feeder of claim 4, wherein said suction means comprises a suction fan, duct means for communicating said suction fan with said plural sucking ports, and mechanical rotary valve means for opening and closing said duct means to communicate or discommunicate said plural sucking ports with said suction fan in synchronism with the proceeding of the conveyance of said first sheet by said sheet feeding and conveying means.

9. The cut sheet feeder of claim 1, wherein said gap serves as complementary means for preventing overlapped feeding of said first and second sheets.

10. The cut sheet feeder of claim 2, wherein said feed belts has its lower running path facing the top face of a stack of cut sheets, and said suction means develops a negative pressure to suck said first sheet from said stack of cut sheets.

11. A cut sheet feeder for feeding out sheets arranged in a stack separately one by one, comprising:

sheet feeding and conveying means for contacting the obverse side of a first sheet to move the first sheet forwardly by frictional force;

arresting means for contacting the reverse side of a second sheet to arrest forward movement of the second sheet, the frictional force applied by said sheet feeding and conveying means being larger than the frictional force applied by said arresting means;

a first suction means operatively associated with said sheet feeding and conveying means for attracting said first sheet to increase the frictional force between said first sheet and said sheet feeding and conveying means; and a second suction means operatively associated with said arresting means for attracting said second sheet to increase the frictional force between said second sheet and said arresting means, wherein said sheet feeding and conveying means comprises a plurality of spaced apart feed belts running around forward and rearward feed rollers, and intermediate rollers disposed between said forward feed roller and said rearward feed roller to face the forward or discharge end of said stack of cut sheets while leaving a gap between said intermediate rollers and said discharge end, and wherein said intermediate rollers protrude through the space between each of said feed belts.

12. The cut feeder of claim 11, wherein said arresting means comprises a reverse roller facing said feed belts and rotating in the direction for moving said second sheet in the backward direction.

13. A cut sheet feeder for feeding cut sheets arranged in a stack separately one by one, comprising:

sheet feeding and conveying means for contacting the obverse side of a first sheet to move the first sheet forwardly by frictional force;

arresting means for contacting the reverse side of a second sheet to arrest forward movement of the second sheet, the frictional force applied by said sheet feeding and conveying means being larger than the frictional force applied by said arresting means; and suction means operatively associated with said arresting means for attracting said second sheet to increase the frictional force between said second sheet and said arresting means, wherein said sheet feeding and conveying means comprises a plurality of spaced apart feed belts running around forward and rearward feed rollers, and intermediate rollers disposed between said forward feed roller and said rearward feed roller to face the forward or discharge end of said stack of cut sheets while leaving a gap between said intermediate rollers and said discharge end, and wherein said intermediate rollers protrude through the space between each of said feed belts.

14. The cut sheet feeder of claim 13, wherein said arresting means comprises a reverse roller facing said feed belts and rotating in the direction for moving said second sheet in the backward direction.

* * * * *